United States Patent [19]

Gloor et al.

[11] 3,997,096

[45] Dec. 14, 1976

[54] ARRANGEMENT FOR COOLING AN EXPLOSIVE CHARGE-DRIVEN SETTING GUN

[75] Inventors: Peter Gloor, Zollikerberg; Max Berchtold, Kusnacht, both of Switzerland

[73] Assignee: Hilti Aktiengesellschaft, Schaan, Liechtenstein

[22] Filed: Mar. 7, 1975

[21] Appl. No.: 556,384

[30] Foreign Application Priority Data

Mar. 8, 1974 Germany ..... 2411168

[52] U.S. Cl. ..... 227/10

[51] Int. Cl.[2] ..... B25C 1/14

[58] Field of Search ..... 227/8, 9, 10

[56] References Cited

UNITED STATES PATENTS

| | | | |
|---|---|---|---|
| 2,966,682 | 1/1961 | Henning | 227/8 |
| 3,060,436 | 10/1962 | DeCaro et al. | 227/10 |
| 3,112,487 | 12/1963 | Hilti | 227/10 |
| 3,563,439 | 2/1971 | Pomeroy | 227/8 |
| 3,658,229 | 4/1972 | Pomeroy | 227/10 |
| 3,860,161 | 1/1975 | Engstrom et al. | 227/10 |

*Primary Examiner*—Granville Y. Custer, Jr.
*Attorney, Agent, or Firm*—Toren, McGeady and Stanger

[57] ABSTRACT

In an explosive charge-driven setting gun used for inserting fastening elements, a piston is axially displaced through a piston guide chamber by the gases generated when a cartridge is exploded within the rearward end of the chamber. To cool the setting gun at least one opening is provided from the piston guide chamber so that the heated gases generated when a cartridge is exploded can be removed after the gases have started the axial movement of the piston. The gases can be directed into the atmosphere creating a suction effect so that cooling air is drawn into the piston guide chamber. Alternatively, the gases can be cooled by passing them through a heat exchanger located externally of the chamber and then returning the cooled gases into the chamber.

6 Claims, 2 Drawing Figures

ARRANGEMENT FOR COOLING AN EXPLOSIVE CHARGE-DRIVEN SETTING GUN

SUMMARY OF THE INVENTION

The present invention is directed to an explosive charge-driven setting gun used for inserting fastening elements, such as bolts, nails and the like, into a receiving material, and, more particularly, it concerns an arrangement for cooling such a setting gun.

In explosive charge-driven setting guns of the type mentioned above, both conventional and caseless cartridges can be used and the type using conventional cartridges are increasingly being employed for rapid firing sequence in the insertion of fastening elements. The rapid firing sequence is found particularly in setting guns which use cartridge magazines or fastening element and cartridge magazines. However, even in setting guns where both the fastening elements and the cartridge are fed individually, it is possible to attain a rapid firing sequence with the guns available at the present time.

One of the disadvantages experienced in setting guns when operated in a rapid firing sequence is that the guns tend to become overheated. Generally, the cartridge chamber and the adjoining parts of the piston guide chamber receive the maximum exposure to the heat developed when a cartridge is exploded. The heat is transferred from these parts to other parts of the gun, for example, to the handle and the jacketed barrel, with the result that the gun becomes so hot after a number of rapid firing setting operations that it can no longer be handled by the operator.

In addition to the problems which occur in handling the setting guns, the overheating also has a negative effect on the operation of the gun. For example, interacting parts can become deformed by expansion caused by overheating so that continued operation of the gun is impaired.

Accordingly, the present invention is directed to the problem of providing an effective arrangement for eliminating the heat generated by the explosion of cartridges for avoiding the harmful overheating effects in such explosive charge-driven setting guns.

Therefore, in accordance with the present invention, one or a number of outlet openings are provided from the piston guide chamber between the rearmost and foremost positions of the piston within the chamber to provide a suction action within the chamber for drawing in a flow of cooling air.

In accordance with the present invention, the gases formed when a cartridge is exploded are used initially to commence the forward movement of the piston for driving a fastening element and after the piston has received sufficient kinetic energy, the hot gases are exhausted from the piston guide chamber in a manner which produces a flow of cooling air into the chamber. The arrangement of the outlet opening or openings between the foremost and rearmost positions of the piston determine the effectiveness of the flow of cooling air which passes over the parts of the setting guns exposed to the heat generated when the gun is fired.

In a preferred embodiment of the invention, the explosion gases are exhausted from the piston guide chamber so that a partial vacuum is developed in the chamber after the piston has moved a certain distance from its rearmost or firing position.

In one embodiment of the invention, the partial vacuum or underpressure can be produced using the principle of the water jet pump, that is, the exhaust or outlet openings from the piston guide chamber is connected in the manner of a water jet pump to a suction pipe with the opposite end of the suction pipe being connected to the piston guide chamber at a location forwardly of the outlet opening through which the explosion gases are exhausted.

In this arrangement after the piston has commenced its forward movement through the piston guide chamber the explosion gases flow from the outlet opening into a storage chamber, and after a delay due to the size of the storage chamber the gases pass from the storage chamber through an ejector into the atmosphere. A partial vacuum or underpressure is produced in the piston guide chamber as a result of the effect of the gas flow through the ejector on the end of the suction pipe spaced outwardly from the guide chamber. Due to the underpressure created within the piston guide chamber, cool air is sucked from the exterior of the gun into and passes through the guide chamber and is also drawn off and discharged into the atmosphere by the ejector. To avoid any interference with the formation of the underpressure due to a back flow of the explosion gases from the storage chamber into the piston guide chamber, a non-return valve or one-way valve is preferably located in the line connecting the outlet opening from the piston guide chamber with the storage chamber.

In another embodiment the partial vacuum in the piston guide chamber is produced by connecting the outlet opening from the chamber to an exhaust pipe which discharges into the atmosphere and is constructed in a known manner to produce the requisite underpressure. Such an exhaust pipe, as known from turbo engines, also provides such an underpressure in the piston guide chamber, after the forward movement of the piston has been effected, that cool air is sucked into the guide chamber from the exterior of the gun.

To limit the resistance to the intake of cooled air from the exterior into the piston guide chamber, the cartridge chamber located at the rear end of the guide chamber is arranged to provide an inlet opening for the cooling flow. This arrangement does not require any special measures, particularly for caseless cartridges, since such cartridges burn without leaving any residue, and under any circumstances openings are provided between the cartridge chamber and the piston chamber which are sufficient to admit cool air into the guide chamber after the cartridge has been exploded. If conventional cartridges using casings are utilized in the setting gun, no special measures are required for providing flow of air into the guide chamber, since the cartridges are held in the magazine even after they are exploded and the part of the guide chamber and the cartridge chamber is automatically lifted from the magazine with the cartridge being displaced from the cartridge chamber as a result of the recoil forces which are developed, so that an opening for drawing cool air into the guide chamber is afforded. If conventional cartridges using casings are utilized and are fed individually into the cartridge chamber, the cool air can be sucked into the guide chamber through an opening containing a one-way or non-return valve.

To operate the setting gun without the flow of outside air into the guide chamber, in another embodiment of the invention the outlet opening can be connected to a heat exchanger with an outlet opening from the heat exchanger connected to an inlet into the guide chamber. In this arrangement, the explosion gases are returned into the piston guide chamber after they are cooled in the heat exchanger and it is advisable to return the cooled gases in the vicinity of the cartridge chamber, that is, in the vicinity where the greatest amount of heating takes place as a result of the firing or exploding of a cartridge.

To discharge any of the cooled air or gases circulated through the piston guide chamber, one or more outlets opening to the atmosphere are provided, preferably adjacent to the foremost position of the piston within the guide chamber.

Preferably, the explosion gases outlet opening has a one-way valve which permits only the outflow of the explosion gas from the guide chamber while preventing any backflow of the gases into the chamber. To prevent the explosion gases from flowing into the heat exchanger before the piston has commenced its forward movement through the guide chamber, the outlet opening from the heat exchanger is preferably provided with a one-way valve which permits only the cooled explosion gases to reenter the piston guide chamber.

Preferably, a storage chamber is located between the outlet opening from the guide chamber and the heat exchanger so that the gases are returned into the piston guide chamber with only a slight delay caused by the flow through the heat exchanger after the piston has completed its forward movement through the guide chamber.

DETAILED DESCRIPTION OF THE INVENTION

Figure 1:
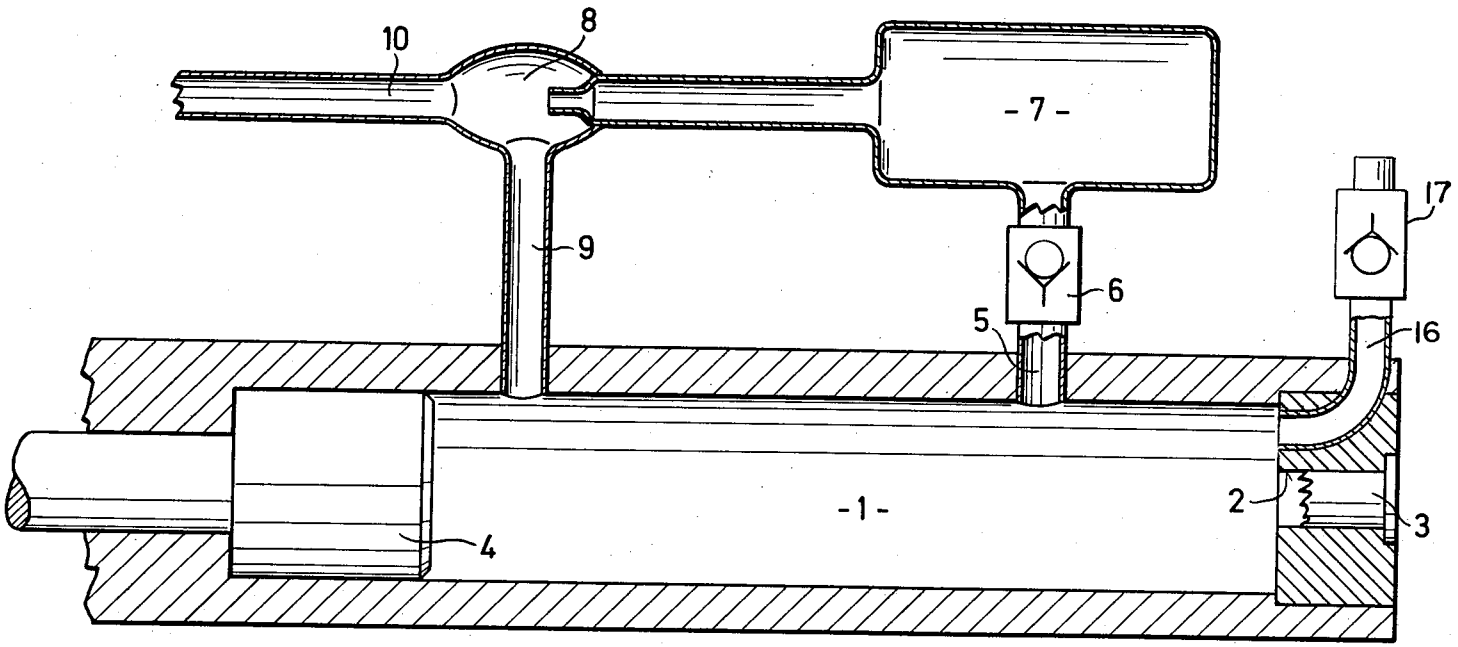
FIG. 1 is a schematic representation, partially in cross-section, of one embodiment of an explosive charge-driven setting gun embodying the present invention.

In FIG. 1 a portion of an explosive charge-driven setting gun is illustrated including a piston guide chamber 1 shown in section. As represented, a cartridge 3 located within a cartridge chamber 2 has already been fired or exploded so that the piston 4 has been displaced from its rearmost position adjacent the cartridge chamber to its foremost position at the forward end of the piston guide chamber 1. In other words, as viewed in FIG. 1, the piston 4 moves from the right to the left when a cartridge is exploded.

An outlet opening 5 is provided in the piston guide chamber 1 adjacent the end containing the cartridge chamber 2 and a one-way or non-return valve 6 is located in the line connecting the outlet opening to a storage chamber 7. Another line extends from the storage chamber to an ejector 8 and a suction pipe 9 connects the ejector with the piston guide chamber 1 rearwardly and adjacent to the position of the piston 4 when it is at the foremost end of the guide chamber. A discharge pipe 10 extends from the ejector 8 and opens to the atmosphere. As can be appreciated, in its rearmost position, the piston 4 blocks the flow of the explosion gases through the outlet opening 5 until the piston has received sufficient energy to propel it through the guide chamber 1 and to drive a fastening element from the setting gun into a receiving material.

In FIG. 1 cool air can be sucked into the guide chmber 1 through an opening or line 16 containing a one-way or non-return valve 17.

Figure 2:
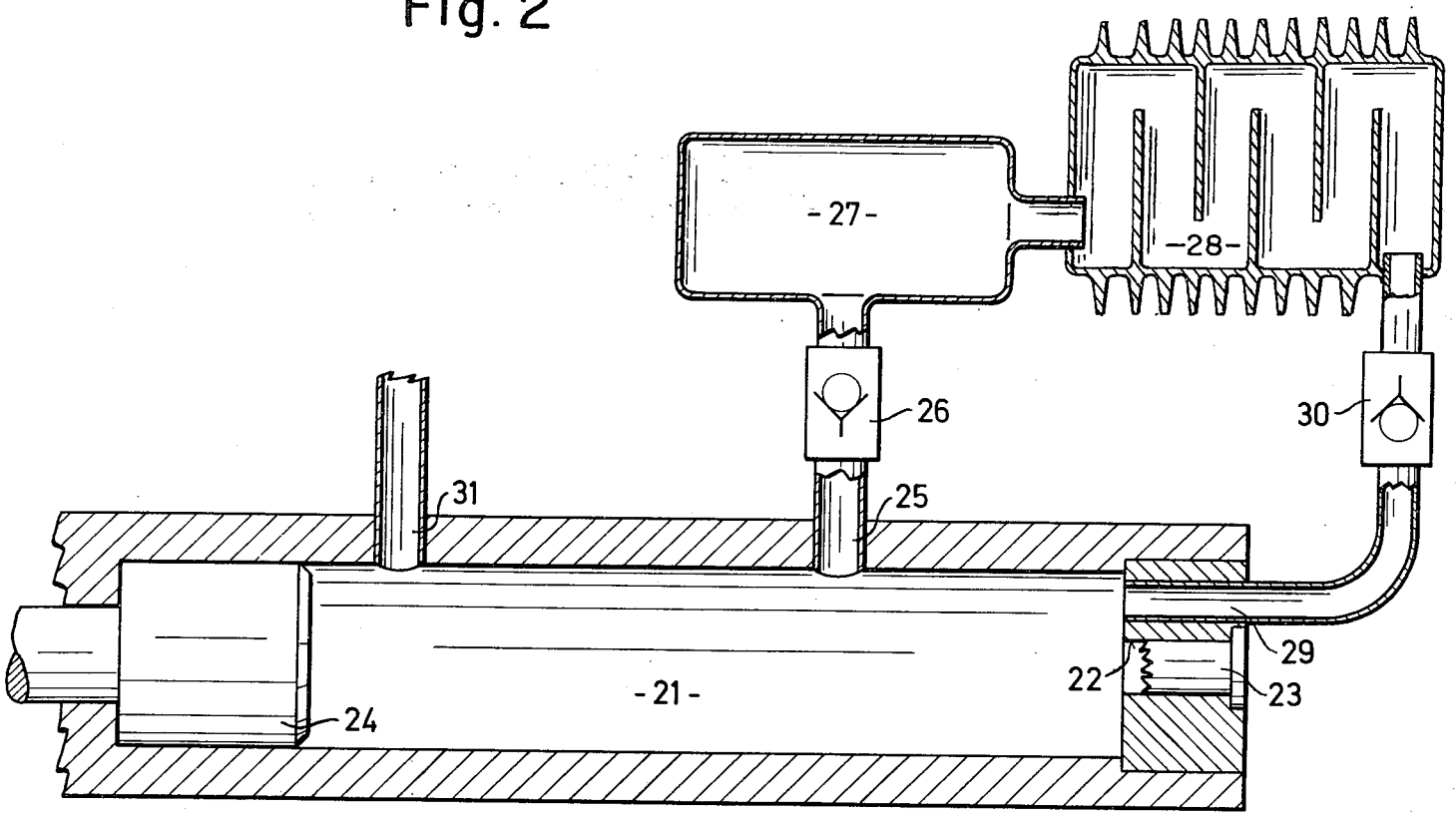
FIG. 2 is a schematic view similar to FIG. 1 illustrating another embodiment of an explosive charge-driven setting gun embodying the present invention.

In another embodiment of an explosive charge-driven setting gun, as shown in FIG. 2, the explosion gases exhausted from piston guide chamber 21 are cooled and returned into the guide chamber. In this embodiment, cartridge 23 located within cartridge chamber 22 has been fired and the piston 24 has been axially displaced through the guide chamber from its rearmost position adjacent the cartridge chamber to its foremost position at the forward end of the chamber.

Spaced axially from the cartridge chamber is an outlet opening 25 which is connected by a one-way valve 26 into a storage chamber 27. The storage chamber 27 is connected to a heat exchanger 28 and a discharge line 29 extends from the heat exchanger to the rearmost end of the piston guide chamber adjacent the cartridge chamber 22. A one-way valve 30 is located in the discharge line 29 from the heat exchanger. Another outlet opening 31 is provided from the piston guide chamber 21 forwardly of outlet opening 25 and rearwardly of the foremost position of the piston 24 as shown in FIG. 2, so that the explosion gases cooled within the heat exchanger 28 and returned into the guide chamber 21 can flow off through opening 31 into the atmosphere.

In the embodiment of FIG. 1 the gases initially drive the piston toward the forward end of the piston guide chamber uncovering the outlet opening 5. The gases flow through the valve 6 into the storage chamber 7 and are prevented from reentering the piston guide chamber by the valve. Because of its size, the gases fill the storage chamber and then commence flow into the ejector where a water jet pump action takes place causing a suction action through the pipe 9 when the piston has moved to the forward end of the guide chamber uncovering the pipe 9 so that the gases remaining in the guide chamber can flow outwardly therethrough. The ejector or water jet pump action directs the gases through the discharge pipe 10. The suction action acting on the piston guide chamber affords a flow of ambient air into the piston guide chamber which provides a cooling effect.

In FIG. 2, as the piston 23 is driven forwardly by an exploding cartridge, it uncovers the outlet opening 25 through which the propellant gases flow through the one-way valve 26 into the storage chamber 27. The gases within the storage chamber then flow into the heat exchanger where they are cooled in indirect heat transfer with the ambient air and then flow through the sidcharge line 29 past the one-way valve 30 back into the piston guide chamber 21 to provide the desired cooling action.

While specific embodiments of the invention have been shown and described in detail to illustrate the application of the inventive principles, it will be understood that the invention may be embodied otherwise without departing from such principles.

What is claimed is:

1. In an explosive charge-driven setting gun for driving fastening elements and the like into a receiving material comprising an axially extending piston guide chamber having a forward end and a rearward end spaced apart in the axial direction and a piston mounted in said guide chamber and having a rear end part guided by said chamber and arranged to be displaced in the axial direction from the rearward end to the forward end of the chamber by the action of the gases generated in the ignition of an explosive charge, wherein the improvement comprises at least one first opening from said guide chamber located between the positions of the rear end part of said piston in the rearward end and in the forward end in said guide chamber, a storage chamber located exteriorly of said guide chamber and having an inlet connected to said at least one first opening and an outlet, at least one second opening from said piston guide chamber located between said at least one first opening and the position of said rear end part of said piston in the forward end of said piston guide chamber, and means connected to said storage chamber for effecting a flow of cooling air into said piston guide chamber.

2. In an explosive charge-driven setting gun, as set forth in claim 1, wherein said means comprises a nozzle at the end of said outlet from said storage chamber, an ejector enclosing said nozzle, a suction pipe connected to the at least one second opening from said guide chamber and to said ejector so that the action of the gases flowing from said storage chamber through the nozzle at the end of said outlet into said ejector effects a suction action through said suction pipe for withdrawing the gases within the piston guide chamber in the manner of a water jet pump establishing a partial vacuum or underpressure for effecting the flow of cooling air into said piston guide chamber.

3. In an explosive charge-driven setting gun, as set forth in claim 1, wherein said means connected to said storage chamber comprises a heat exchanger in communication with the outlet from said storage chamber, said heat exchanger having an outlet opening connected to said piston guide chamber so that gases flowing from said at least one first opening into said storage chamber, pass through said heat exchanger for effecting heat transfer from the gases and for returning the cooled gases through the outlet from said heat exchanger into said piston guide chamber.

4. In an explosive charge-driven setting gun, as set forth in claim 3, wherein the outlet from said heat exchanger is connected to said piston guide chamber at the rearward end thereof.

5. In an explosive charge-driven setting gun, as set forth in claim 1, wherein a one-way valve is located in the inlet extending between said at least one first opening and said storage chamber so that gases can issue only from said piston guide chamber to said storage chamber through said inlet.

6. In an explosive charge-driven setting gun, as set forth in claim 3, wherein a one-way valve is located in said outlet from said heat exchanger to said piston guide chamber so that only cooled gases flow from said heat exchanger into said piston guide chamber.

* * * * *